US005400559A

United States Patent [19]

Nicholas

[11] Patent Number: 5,400,559

[45] Date of Patent: Mar. 28, 1995

[54] MULTI-FUNCTIONAL UNIVERSAL MEMBER FOR ARCHITECTURAL JOINT SYSTEMS

[75] Inventor: John D. Nicholas, Lawrenceville, Ga.

[73] Assignee: Pawling Corporation, Pawling, N.Y.

[21] Appl. No.: 233,730

[22] Filed: Apr. 26, 1994

Related U.S. Application Data

[63] Continuation of Ser. No. 881,493, Mar. 11, 1992, abandoned.

[51] Int. Cl.[6] ..... E04B 1/68; E01C 11/02

[52] U.S. Cl. ..... 52/396.05; 52/396.04; 52/465; 404/47; 404/55

[58] Field of Search ..... 52/393, 396.04, 465, 52/466, 467, 469, 470, 472, 573, 396.05; 404/47, 55, 57, 67, 69

[56] References Cited

U.S. PATENT DOCUMENTS

| | | | |
|---|---|---|---|
| 3,183,626 | 5/1965 | Schmitt . | |
| 3,659,390 | 5/1972 | Balzer et al. | 52/573 |
| 3,750,359 | 8/1973 | Balzer et al. | 52/396 |
| 4,504,170 | 3/1985 | Schukolinski | 52/573 |
| 4,566,242 | 1/9186 | Dunsworth . | |
| 4,589,242 | 5/1986 | Moulinie et al. . | |
| 4,885,885 | 12/1989 | Gottsehling | 52/573 |
| 4,967,527 | 11/1990 | Gohlke . | |
| 5,078,529 | 1/1992 | Moulton | 52/573 |

OTHER PUBLICATIONS

Article "Metalines Expansion & Seismic Joint Covers", pp. 4–8.

Article "C/S Expansion Joint Systems", pp. 14–15.

Article "MM Systems Corporation", pp. 6,7,12,13.

*Primary Examiner*—Carl D. Friedman

*Assistant Examiner*—Winnie Yip

*Attorney, Agent, or Firm*—Schweitzer Cornman & Gross

[57] ABSTRACT

A multi-functional, universal guide rail member is provided, for incorporation in an architectural joint system. Typically, one such guide rail member is mounted on each of two adjacent, relatively movable structures and cooperates with pivotally mounted centering bars to maintain a covering plate in centered position. The guide rail member incorporates in a single, integral unit a continuous guide groove for the centering bars, an open-sided slot for receiving fastening means (or, in some cases, caulking), and an outwardly facing slot for receiving anchoring means. The multi-functional guide rail member is usefully employed in conjunction with standard off-the-shelf structural components, such as channels and angle members, to accommodate mounting of the guide rail members in a variety of architectural configurations. In some architectural joint systems the multi-functional guide rail members may be employed in a manner making use of less than all of their functions, adding to the universality and economy of the system.

1 Claim, 3 Drawing Sheets

MULTI-FUNCTIONAL UNIVERSAL MEMBER FOR ARCHITECTURAL JOINT SYSTEMS

RELATED APPLICATIONS

This application is a continuation of application Ser. No. 881,493, filed Mar. 11, 1992, now abandoned.

BACKGROUND AND SUMMARY OF THE INVENTION

Conventional construction practices frequently call for the provision of a space between adjacent structures or substructures, for example to accommodate normal expansion and contraction, to afford a degree of relative motion to limit damage from seismic activity, or other reasons. Such spaces are covered by architectural joint systems, designed to permit the necessary motion of the adjacent structures. In one well known design of such architectural joint systems, a flat cover plate is provided to span the space between the adjacent, relatively movable structures, typically with special support elements being mounted at each side to provide for support and control of the cover plate. The cover plate has a width sufficient to accommodate the maximum anticipated separation of the adjacent structures, and the arrangement also allows for the structures to approach each other to a calculated minimum separation by sliding underneath the cover plate.

In some architectural joint systems of the general type described above, it is common to provide means for maintaining the cover plate in a centered or approximately centered relationship to the adjacent structures, as the space between them expands and contracts. One advantageous arrangement for this purpose involves the provision of guide rail members secured to the respective structures, at opposite sides of the intervening space. A plurality of centering bars, of substantially greater length than the maximum space between the structures, are provided with guide means at their opposite ends received in grooves in the respective guide rail members. The centering bars are pivotally connected at their midpoints to center points of the cover plate. Accordingly, as the adjacent structures move toward and away from each other, the centering bars rotate, maintaining their center points midway between the adjacent structures and at the same time serving to maintain the location of the cover plate evenly centered regardless of the width of the space. Prior art examples of such mechanisms are represented by the Schmitt U.S. Pat. No. 3,183,626 and the Dunsworth U.S. Pat. No. 4,566,242, for example. The present invention is directed to a multi-functional, universal guide rail member which, in addition to other uses, is advantageously employed in a cover mechanism of this general type, leading to substantial economies of manufacture and installation.

In accordance with one aspect of the invention, a unique and advantageous universal, multi-functional guide rail element is provided, which can be utilized in a wide variety of structural environments, resulting in an enormous reduction in the inventory requirements of specialized parts. In this respect, in a common form of installation of the cover structures for architectural joint systems, it is customary to provide recesses or block-outs in the adjacent concrete structures, for receiving the components of the joint system while providing a substantially flush surface configuration. Typically, the dimensions of such block-out areas may vary widely, not only by initial design but as a function of tolerance variations in the construction procedure. Accordingly, it has been necessary, heretofore, for the joint manufacturer to carry in its regular operating inventory a wide variety of sizes and shapes of specially contoured parts, for installation in a wide variety of configurations. With the system of the present invention, however, a single, multi-functional guide rail member may be combined with a wide variety of standard off-the-shelf components, such as channels and angles, to enable installations in a wide variety of configurations. Thus, for a given strength and weight of structure, a single multi-functional guide rail member may be employed for all installed configurations. For different depths and widths of block-out areas, the multi-functional guide rail member is employed with stock, off-the-shelf channel and/or angle members of different standard sizes and configurations. Where predicted tolerances are not realized, and special sizing is required, that can be performed with inexpensive modifications to the off-the-shelf components without requiring new designs or modifications to the structure and configuration of the guide rail member itself.

As a specific: feature of the invention, a novel and improved guide rail member of multi-functional configuration is provided, which incorporates in a single, continuous (typically extruded) section, a guide groove for engaging and slidably retaining the end of a centering bar, an upwardly facing continuous screw-receiving slot, provided on its sidewalls with thread-engaging serrations, and a continuous, open-sided bolt-receiving slot, for engagement of anchoring bolts. By combining all of these features into a unitary, multi-functional guide rail structure, the required number of specially configured components is reduced to a minimum, and the variables involved in a given installation, be they by design or tolerance variation, are accommodated by the installation of off-the-shelf components, such as channels, angles and the like.

The multi-functional guide rail member of the invention has significant utility also in architectural joint systems in which a centering means is not employed, for example in the mounting of a cover plate in fixed relation to one of two movable structures, allowing the plate to move relative to the other structure to accommodate expansion and contraction, without regard to attempting to center the cover plate. In these and other modes of utilization, some but less than all of the functional features of the member may be employed. Nevertheless, significant advantages are realized in that a single, versatile component can be inventoried to perform a multiplicity of tasks in the various possible structural configurations.

For a more complete understanding of the above and other features and advantages of the invention, reference should be made to the following detailed description of preferred embodiments of the invention and the accompanying drawings.

DESCRIPTION OF THE PREFERRED EMBODIMENTS

Figure 1:
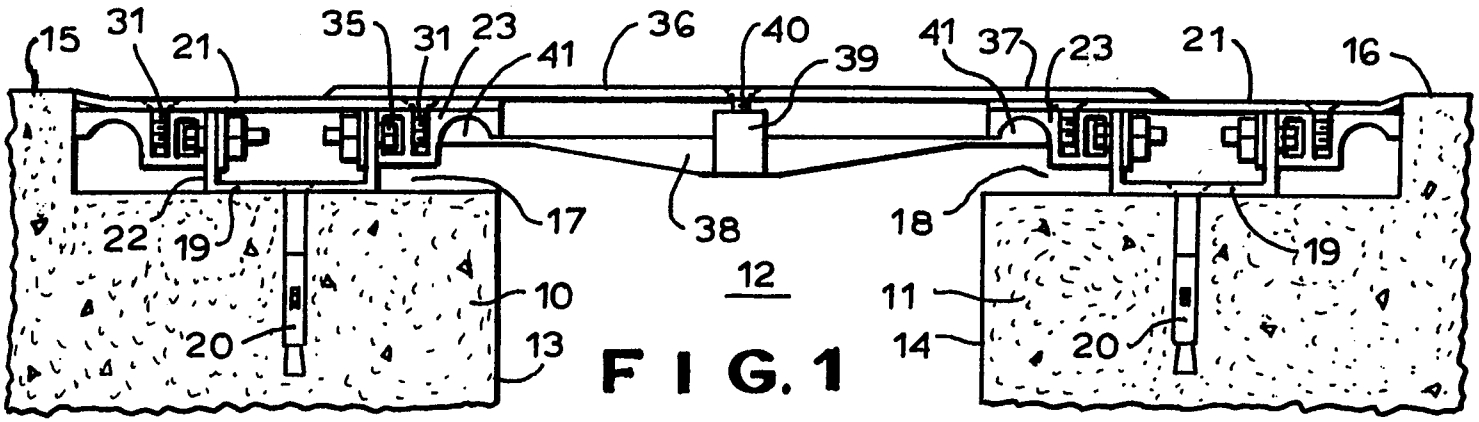
FIG. 1 is a fragmentary cross sectional view, showing an architectural joint system incorporating features of the invention, installed between adjacent structures.

Referring now to the drawing, the reference numerals 10, 11 designate spaced-apart, relatively movable architectural structures defining an open space 12 between their opposed, inner walls 13, 14. In a typical case, the two structures 10, 11 may constitute adjacent floor sections, for example, which are designed to accommodate relative motion as a function of expansion and contraction, seismic activity, or a combination of these and other factors.

In a typical design application, the upper surfaces 15, 16 of the structures are provided at their adjacent, inner corner areas with recesses or block-outs 17, 18 designed for receiving the components of an architectural joint system, which spans and covers the variable open space.

In the illustration of FIG. 1, channels 19 are secured to the respective structures 10, 11, by means of anchor bolts 20. The channels extend along the length of the joint, and are selected to have a vertical height appropriate to the depth of the block-out areas 1.7, 18. The channels 19 are standard off-the-shelf structural components readily available to the installation contractor from a source at or near the installation site.

In the installation of FIG. 1, the width of the block-out area 17, 18 is substantially greater than the width of the channel members 19. A side cover plate 21 is received over and supported by the vertical walls or flanges 22 of the channel and is of a width to cover substantially the entire block-out area. The side cover plates are rigidly secured to the channel members 19 by means of special multi-functional guide rail members 23, which are anchored to each of the vertical legs 22 of the channel sections and extend laterally therefrom.

Figure 3:
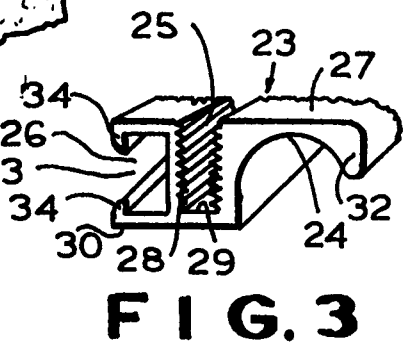
FIG. 3 is an enlarged, cross sectional view of a multi-functional, universal centering guide rail member according to the present invention as incorporated in the structures of FIG. 1 and FIG. 2.

With reference particularly to FIG. 3 of the drawing, the multi-functional guide rail member comprises an elongated section of uniform cross section, typically formed by extrusion. For most applications, the guide rail member may be extruded of aluminum. Depending upon strength requirements, however, structural plastic materials may be employed in appropriate cases. Likewise, materials of greater strength than aluminum may be required in certain instances.

Pursuant to the invention, the guide rail member 23 incorporates in a single, integral section at least three functional elements, including a centering guide groove 24, located along the inside edge of the guide rail member, an upwardly (in the orientation shown) opening slot 25 for receiving fastening means or, in some cases, gasketing materials, and a laterally opening bolt receiving slot 26 along the outside edge of the guide rail member. While the specific configuration of the guide rail member may vary from that shown in FIG. 3, it is important that the three functions be incorporated in a single, integral element.

As shown in FIG. 3, the guide rail element 23 is of generally rectangular outline, being provided with a generally flat upper surface 27, for supporting the side cover plates 21, as shown in the FIG. 1 installation, for example. The slot 25, itself a known feature, is provided with parallel, serrated sidewalls 28 which, together with the bottom wall 29, form a slot whose depth is less than the height of the guide rail member between its upper wall 27 and its bottom wall 30. The slot 25 is arranged to receive a plurality of screws 31 or other fastening devices at spaced locations, for securely mounting the side cover plates 21.

In the illustrated configuration of the guide rail member 23, the guide groove 24 is of semi-cylindrical contour, opening downwardly. The outer portion of the groove defines a downwardly extending flange 32 forming the inside edge of the guide rail member. At the opposite side of the guide rail member the bolt-receiving channel 26 has an open side 33 defined by upper and lower flanges 34. The channel 26 is adapted to receive a bolt head or a nut, as the case may be, sized to prevent rotation within the slot.

In the installation of FIG. 1, it will be seen that the depth of the block-out portions 17, 18 is substantially greater than the height of the guide rail members 23. Accordingly, the guide rail members are anchored in an elevated position, by securing the same to upper portions of the channel vertical sidewalls 22, using anchor bolts 35 received in the channels 26 and extending through drilled holes (not shown) provided in the channel vertical walls.

In the illustration of FIG. 1, because of the substantial width of the block-out areas 17, 18, guide rail elements are provided on both the inside and outside vertical walls of the channels 19, being mounted spaced above the bottom surfaces of the block-out areas and preferably flush with the upper ends of the channel vertical legs 22. Accordingly, the upper surface portions 27 of the guide rail elements provide a laterally extending support surface for the side cover plates 21, which are rigidly secured to the guide rail members by the screws 31 or other fastening devices.

A flat center cover plate 36 spans the center space 12 and has its opposite side edge margins 37 supported by the respective opposite side cover plates 21. A plurality of centering bars 38 are pivotally connected at their center posts 39 to the center cover plate 36, by means of screws 40. At their opposite ends, the centering bars 38 are provided with semi-spherical guide elements 41, which project upward into the semi-cylindrical guide grooves 24 in the respective guide rail members 23 at opposite sides of the space 12.

In accordance with known principles, the length of the centering bars 38 is substantially greater than the maximum width of the space 12, such that the centering bars 38 always lie at an acute angle with respect to the guide rail members 23. As the space 12, between the relatively movable structures 10, 11, expands and contracts, moving the respective guide rail members toward and away from each other, the centering bars 38 rotate about their center posts 39, maintaining the cover plate 36 properly centered with respect to the space 12.

Figure 2:
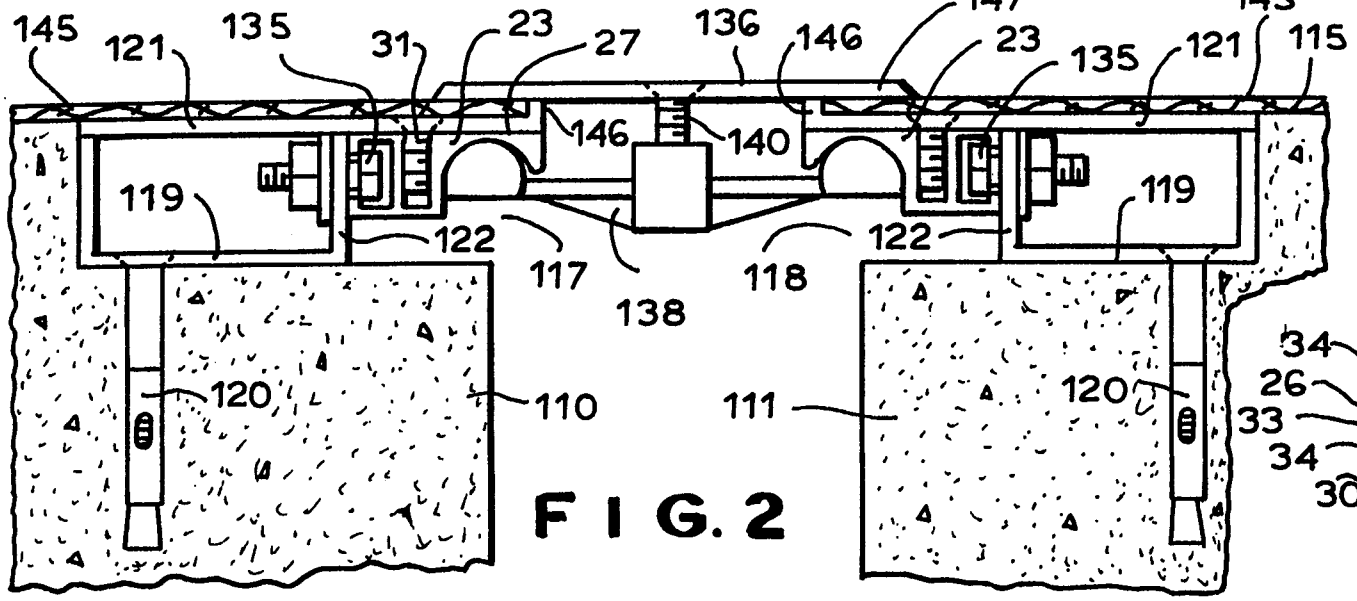
FIG. 2 is a cross sectional view, similar to FIG. 1, illustrating a modified form of architectural joint system incorporating features of the invention.

In the architectural joint system shown in FIG. 2, block-out areas 117,118, provided in the respective relatively movable structures 110, 111, are of lesser width than the block-out area 17, 18 of the FIG. 1 version. Accordingly, for the FIG. 2 installation, the installing contractor may locate the standard channel members 119 at the outer extremities of the block-out portions, securing them with anchor bolts 120. Multi-functional guide rail members 23 are anchored rigidly to the inner vertical legs 122 of the channels, using anchor bolts 135 in the manner generally described with respect to FIG. 1.

Side cover plates 121 extend across the top of the channels 119 and over the top surfaces 27 of the guide rail members. The side cover plates 121 are rigidly secured to the guide rail members by means of screws 31 received in the upwardly opening slots 25 therein. The height of the channels 119 is selected to support the side cover plates 121 substantially flush with the upper surfaces 115 of the architectural structures. In the illustration of FIG. 2, the structures 110, 111 are provided with a floor covering 145. Accordingly, the side cover plates 121 desirably are provided with upwardly projecting flanges 146 at their inner edges, of a height corresponding to the thickness of the floor covering 145. A center cover ]plate 136 is supported by the flanges 146, and is arranged so that its opposite side margins 147 extend over the top of the covering material 145. A plurality of centering bars 138 are pivotally secured to the center cover plate 136 by screws 140. The centering bars function to center the cover plate 136 in the manner described with respect to FIG. 1.

Figure 4:
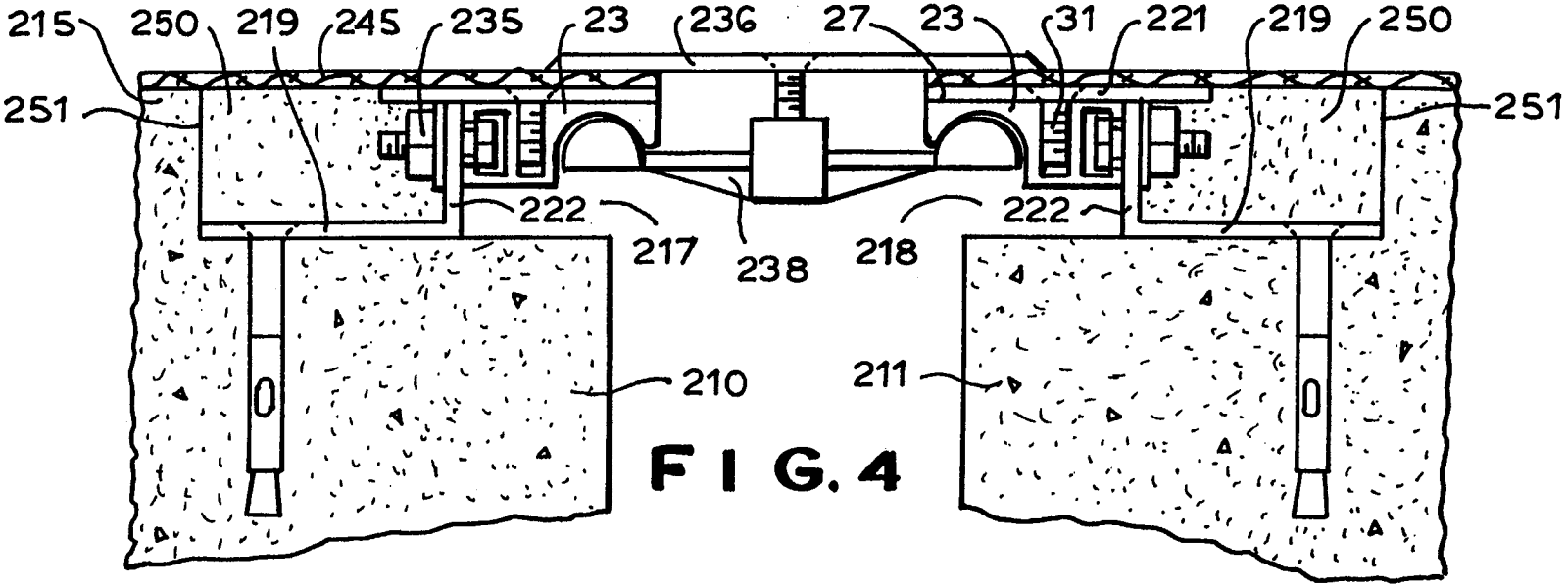
FIGS. 4 and 5 are cross sectional views of still further modifications of architectural joint systems incorporating features of the invention.

In the illustration of FIG. 4, off-the-shelf, standard angle members 219 are placed in the respective block-out areas 217, 218 of the spaced-apart structures 210, 211. The angle members are arranged with their vertical flanges or walls 222 oriented to the inside for mounting of opposed multi-functional guide rail members 23 adjacent the upper edges of the vertical walls, using anchor bolts 235 in the manner previously described. In the arrangement of FIG. 4, relatively short side cover plates 221 extend over and are supported by the upper surfaces 27 of the guide rail members, being secured rigidly thereto by means of screws 31. Outer edge portions of the side cover plates 221 extend over the tops of the vertical flange walls 222 and a short distance beyond.

In the configuration of FIG. 4, the space above the angle members 219 is filled with a grout 250 to provide a continuation of the floor surface 215. Accordingly, the side cover plates 221 need not extend all the way to the outer edges 251 of the block-out areas. The center cover plate 236 of the FIG. 4 arrangement is positioned by means of centering bars 238 in the manner heretofore described, with side portions of the cover plate resting directly upon a floor covering material 245.

Figure 5:
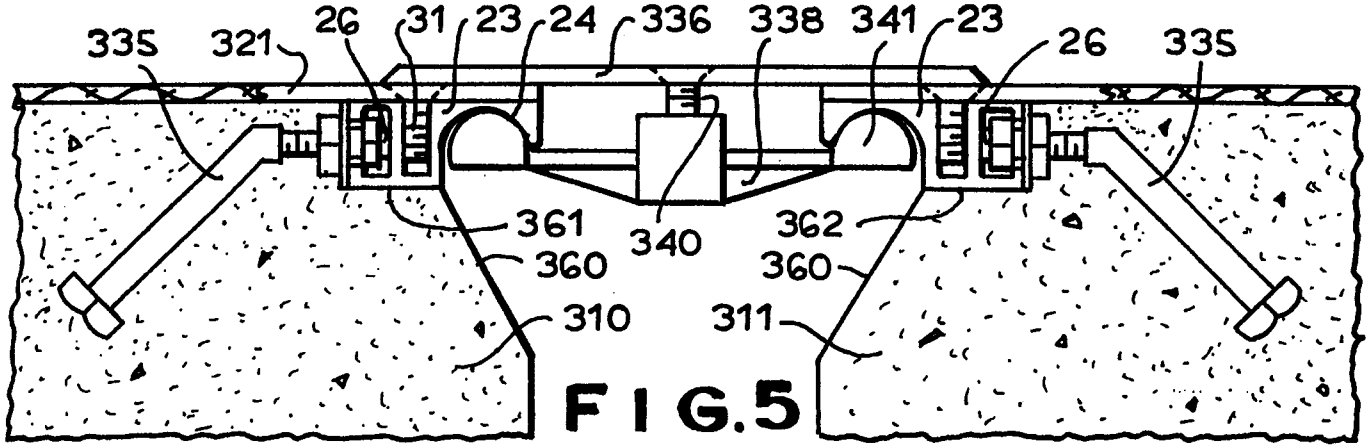

The embodiment of FIG. 5 illustrates utilization of the new centering guide rail member 23 in a cast-in-place installation. For this installation, the guide rails 23 are initially prepared with a plurality of anchor bolts 335, which are tightly engaged in the bolt receiving slot 26. Initially, the rails are held in desired position by suitable forms (not shown). Concrete is poured into the forms to create the opposed, relatively movable structures 310, 311, with the bolts 335 being embedded within the poured concrete. The guide rail members 23, in conjunction with liners 360, constitute the block-out form defining the recesses 361, 362 in which the guide rail members are received.

In the FIG. 5 embodiment, the inner portions of the guide rail members, containing the semi-cylindrical guide grooves 24 project inward, into the space 312, to receive the semi-spherical elements 341 of the centering bars 338. Side covering plates 321 are secured to and supported by the upper surfaces of the guide rail members by screws 31, providing a smooth support surface for opposite side margins of the center cover plate 336. The center cover plate is secured to the centering bars 338 by means of screws 340.

Figure 6:
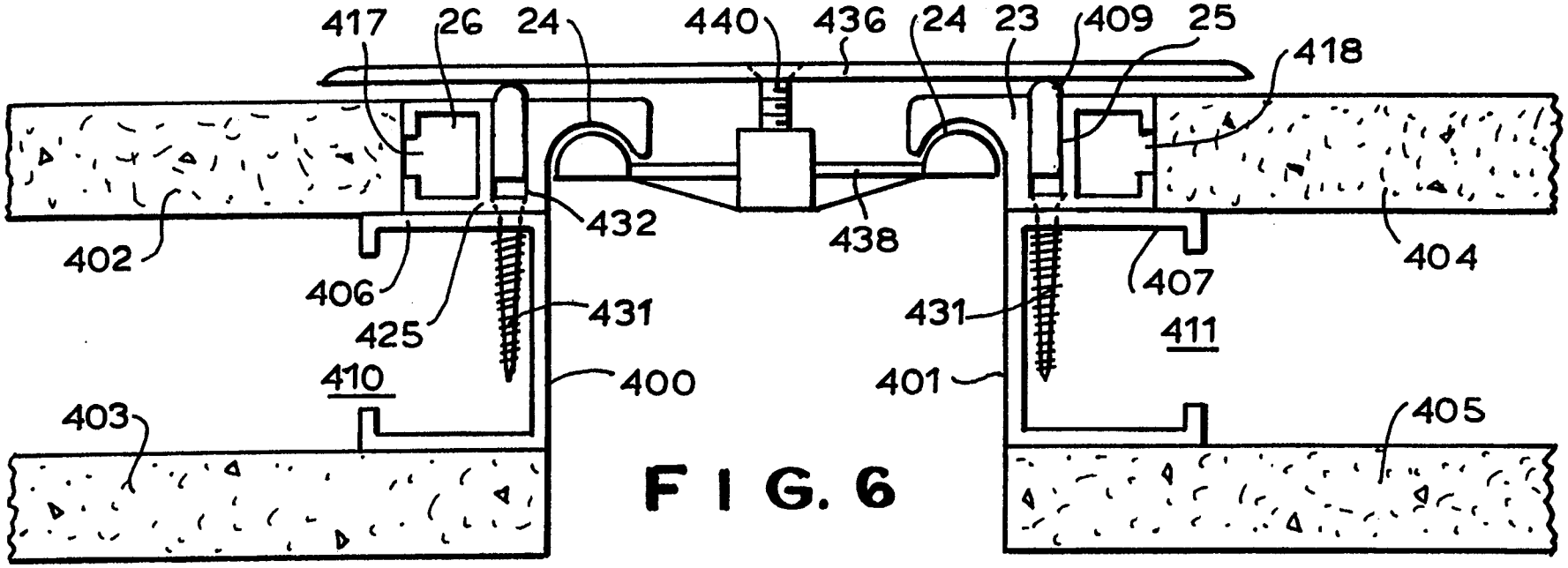
FIG. 6 is an advantageous form of wall joint, incorporating features of the invention.

In the modification of FIG. 6, the multi-functional guide rail member of the invention is incorporated in an architectural joint system mounted between adjacent wall sections. In the illustration, metal studs 400, 401 form the ends of the respective movable wall structures 410, 411. Front and back dry wall panels 402, 403 and 404, 405 are secured to the respective studs 400, 401 in a more or less conventional wall construction arrangement. On the exposed side of the wall structures 410, 411, the outer wall panels 402, 404 are inset a short distance, providing block-out areas 417, 418 arranged for the reception of multi-functional guide rail members 23. To advantage, the height of the guide rail member approximates the thickness of wall panels 402, 404.

In the arrangement of FIG. 6, the bolt receiving slots 26 are unused, and the guide rail members 23 are mounted to their respective structures 410, 411 by means of self-tapping dry wall screws 431. For this purpose, the bottom walls 425 of the open-sided slots 25 are drilled through, to receive the screws 431. These screws are sized such that they fit between the walls of the slots 25, which are thereafter filled with caulking material 409. The screws thus can serve to tightly secure the rails 23 to the front walls 406, 407 of the metal studs. The respective guide rail members are mounted such that their semi-cylindrical guide grooves 24 extend out into the open space 412, where they engage with centering bars 438 in the manner previously described. The centering bars are carried by a center cover plate 436, by means of screws 440.

Figure 7:
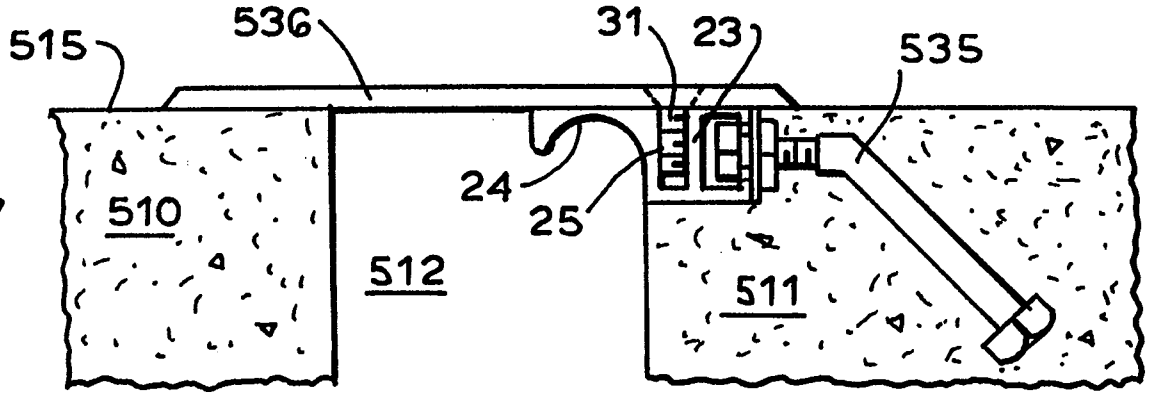
FIG. 7 is a cross sectional view of an architectural joint system incorporating features of the invention, in which a cover plate is fixed to one of the structures and slidable with respect to the other.

In the modification of FIG. 7, opposed structures 510, 511 are provided with a simplified form of architectural joint system to cover the joint space 512. In the FIG. 7 modification, a multi-functional guide rail member 23 according to the invention is cast in place in one of the structures 511, using means such as anchor bolts 535 received in the slots 26. The guide rail member 23 mounts a cover plate 536, which is secured by means of screws 31 received in the open-sided slots 25. In this instance, the cover plate 536 is rigidly attached to the structure 511 and extends across the space 512 and for a predetermined distance over the top surface 515 of the opposed structure 510. Thus, as the structures 510, 511 move toward and away from each other, the cover 536 slides over the top surface 515 of one of the structures 510 but remains immovable with respect to the opposite structure. In the FIG. 6 modification, the semi-cylindrical guide groove portion 24 of the multi-functional guide rail element is unused.

As will be appreciated from the above described illustrations of various architectural joint systems, important advantages and economies are derived from the use of the unique multi-functional, universal guide rail member 23. The design of this guide rail member enables it to be utilized in a wide variety of installations, either by itself or in combination with standard off-the-shelf structural components such as channels and angle members. Whereas prior art designs of a similar general type have required the manufacturer and/or contractor to maintain a large inventory of custom components, in order to accommodate the various structural configurations encountered in the field, a system according to the present invention enables a single custom component, the multi-functional guide rail member, to be employed in a wide variety of circumstances. Different configurations of block-outs, for example, can be accommodated by selection of appropriately sized off-the-shelf standard structural components, which are readily available to the installation contractor. Moreover, if particular circumstances are not met by standard off-the-shelf components, the installation contractor can modify the off-the-shelf component much more easily and economically than preparing a special custom component and/or modifying the custom component.

While the individual features incorporated in the multi-functional guide rail member of the invention are in themselves well known, and certain prior art designs of cover centering mechanisms have incorporated one or two of the features in a single element, none has found a way to combine all three usefully into a single, multi-functional element as in the case of the present invention. The ability to effectively combine all three elements, guide groove, slot and bolt-receiving slot, into a single multi-functional guide rail element enables extraordinary and unexpected economies and advantages to be realized.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention. By way of example, in the above description and in the following claims, directional and orientational references, such as top, bottom, upward, downward, etc. are employed for convenience of description only as the elements of the structure perform identically whether oriented horizontally, vertically or otherwise, and whether used in the orientations illustrated in the drawings or in reversed or upside down orientations.

I claim:

1. A multi-functional, universal guide rail member for an architectural joint system which comprises, (a) a unitary extruded section having a uniform, generally rectangular cross sectional envelope comprising upper and lower walls and inner and outer end walls, (b) said extruded section having an upper principal support surface and a lower principal mounting surface and inner and outer side edges defining the walls of said rectangular envelope, (c) said upper support surface defining the upper wall of said rectangular envelope and extending therealong from one side edge to the other of said guide rail member and from one end wall to the other Of said rectangular envelope to provide a generally flat, substantially continuous support, (d) said lower mounting surface being parallel to said upper support surface and defining a lower wall of said envelope, (e) said lower mounting surface extending from the outer end wall of said rectangular envelope toward said inner end wall thereof for at least about one half the distance between said envelope end walls and providing a generally flat, substantially continuous mounting base for securing said guide rail member to a structure, (f) said guide rail member having, intermediate its side edge portions and within the portion thereof defined by inner and outer extremities of said lower mounting surface, a longitudinally continuous, upwardly opening slot of generally uniform width extending from said upper support surface toward said lower mounting surface and terminating at a point spaced above said lower mounting surface, (g) said continuous slot being defined by spaced apart inner and outer slot walls extending from said upper support surface to a point closely adjacent to said lower mounting surface, (h) surfaces of said slot walls facing said continuous slot being longitudinally serrated and thereby adapted for the reception of attachment means of a first type in the form of threaded elements extending into said slot from above, (i) said continuous slot further being adapted to receive attachment means of a second type for projection downward from the bottom point of said slot and through said lower mounting surface for mounting said guide rail member with its lower mounting surface engaging an underlying support member, (j) said guide rail member having, at its inner edge portion, a downwardly opening guide groove defined in part by at least one guide flange and underlying an inner edge portion of said upper support surface, (k) said guide flange defining the inner end wall of said rectangular envelope and extending downward from the upper wall of said envelope, (l) said guide groove being adapted for the slidable reception and guidance of a centering device, (m) said guide rail member having, at its outer edge, a laterally opening, open-sided channel partially closed by upper and lower vertical retaining flanges, (n) said retaining flanges defining the outer walls of said rectangular envelope, (o) said open-sided channel being adapted for the reception of anchoring means, (p) said open-sided channel being defined in part by upper and lower walls and an inner end wall, (q) said upper and lower walls forming part of said upper support surface and said lower mounting surface respectively, and (r) said channel inner end wall comprising said outer slot wall.

* * * * *